US012404790B2

(12) United States Patent
Rao

(10) Patent No.: US 12,404,790 B2
(45) Date of Patent: Sep. 2, 2025

(54) EXHAUST SILENCING DEVICE AND SYSTEM, VEHICLE, AND EXHAUST SILENCING METHOD

(71) Applicants: ZHEJIANG GEELY HOLDING GROUP CO., LTD, Zhejiang (CN); ZHEJIANG LIANKONG TECHNOLOGIES CO., LTD., Zhejiang (CN)

(72) Inventor: Peng Rao, Zhejiang (CN)

(73) Assignees: ZHEJIANG GEELY HOLDING GROUP CO., LTD, Hangzhou (CN); ZHEJIANG LIANKONG TECHNOLOGIES CO., LTD., Ningbo (CN)

( * ) Notice: Subject to any disclaimer, the term of this patent is extended or adjusted under 35 U.S.C. 154(b) by 357 days.

(21) Appl. No.: 18/016,000

(22) PCT Filed: Jul. 14, 2020

(86) PCT No.: PCT/CN2020/101769
§ 371 (c)(1),
(2) Date: Jan. 13, 2023

(87) PCT Pub. No.: WO2022/011525
PCT Pub. Date: Jan. 20, 2022

(65) Prior Publication Data

US 2023/0212968 A1 Jul. 6, 2023

(51) Int. Cl.
*F01N 1/16* (2006.01)
*F01N 13/18* (2010.01)

(52) U.S. Cl.
CPC ..... *F01N 1/165* (2013.01); *F01N 1/166* (2013.01); *F01N 13/1844* (2013.01)

(58) Field of Classification Search
CPC ..... F01N 1/165; F01N 1/166; F01N 13/011; F01N 13/04; B60K 13/04; B60K 13/06
See application file for complete search history.

(56) References Cited

U.S. PATENT DOCUMENTS 5,388,408 A * 2/1995 Lawrence ..... F01N 13/02 181/239
6,755,279 B2 * 6/2004 Kaneko ..... F01N 1/10 181/254

(Continued)

FOREIGN PATENT DOCUMENTS

CN 103867274 A 6/2014
CN 204163817 U 2/2015

(Continued)

OTHER PUBLICATIONS

Chinese Intellectual Property Office (ISR/CN), "International Search Report for PCT/CN2020/101769", China, Feb. 18, 2021.

(Continued)

*Primary Examiner* — Jeffrey J Restifo
(74) *Attorney, Agent, or Firm* — Westbridge IP LLC

(57) ABSTRACT

An exhaust silencing device and system, a vehicle, and an exhaust silencing method. The exhaust silencing device comprises an air intake pipe (1), a main exhaust silencing cylinder (2), a main exhaust pipe (3), a multi-way valve (6), at least one auxiliary exhaust silencing device (4), and at least one auxiliary exhaust pipe (5); the multi-way valve (6) is in communication with the air intake pipe (1), the main exhaust pipe (3), and the auxiliary exhaust pipe (5); the main exhaust silencing cylinder (2) has one end in communication with the multi-way valve (6) by means of the main exhaust pipe (3), and another end in communication with the outside; and the auxiliary exhaust silencing device (4) has one end in communication with the multi-way valve (6) by means of (Continued)

the auxiliary exhaust pipe (5), and another end in communication with the outside.

19 Claims, 5 Drawing Sheets

(56) References Cited

U.S. PATENT DOCUMENTS

| | | | | |
|---|---|---|---|---|
| 6,896,000 | B2 * | 5/2005 | Brenner | F01N 3/0878 60/301 |
| 6,938,729 | B2 * | 9/2005 | Worner | F01N 13/02 181/254 |
| 7,040,451 | B2 * | 5/2006 | Schumacher | F01N 13/011 181/254 |
| 7,090,048 | B2 * | 8/2006 | Albertson | F01N 1/166 181/254 |
| 7,640,728 | B2 * | 1/2010 | Yoshizaki | F01N 3/2093 60/287 |
| 7,703,574 | B2 * | 4/2010 | Kruger | F01N 13/08 181/254 |
| 8,037,672 | B2 * | 10/2011 | Gaskins | F01N 11/002 60/276 |
| 8,991,178 | B2 * | 3/2015 | Schlund | F02B 37/16 123/562 |
| 9,206,726 | B2 * | 12/2015 | Cuellar | F01N 3/2066 |
| 9,212,593 | B2 * | 12/2015 | An | F01N 13/04 |
| 9,435,242 | B2 * | 9/2016 | Kopp | F01N 13/107 |
| 9,765,666 | B2 * | 9/2017 | Smith | F01N 13/04 |
| 10,358,956 | B1 * | 7/2019 | Egan | F01N 13/02 |
| 10,436,085 | B2 * | 10/2019 | Pompucci | F01N 1/166 |
| 10,584,626 | B2 * | 3/2020 | Herwat | B60K 13/04 |
| 10,605,133 | B2 * | 3/2020 | Akrapovic | F01N 1/168 |
| 10,753,264 | B2 * | 8/2020 | Klemenc | F01N 1/06 |
| 11,506,096 | B2 * | 11/2022 | Ballatore | F01N 13/20 |
| 11,959,406 | B2 * | 4/2024 | Ballatore | F01N 13/085 |
| 11,988,124 | B2 * | 5/2024 | Ballatore | G10K 11/161 |
| 2002/0175022 | A1 | 11/2002 | Schumacher et al. | |
| 2009/0308057 | A1 * | 12/2009 | Fresnet | F01N 3/0885 60/287 |
| 2014/0166394 | A1 * | 6/2014 | Winkel | F01N 1/02 181/228 |
| 2017/0298802 | A1 * | 10/2017 | Hwang | F01N 13/107 |
| 2023/0212968 | A1 * | 7/2023 | Rao | F01N 13/1844 180/309 |
| 2025/0067201 | A1 * | 2/2025 | Ostromecki | F01N 1/04 |
| 2025/0067202 | A1 * | 2/2025 | Figuretti | F01N 1/165 |

FOREIGN PATENT DOCUMENTS

| | | | |
|---|---|---|---|
| CN | 204921116 | U | 12/2015 |
| CN | 204941679 | U | 1/2016 |
| CN | 107237675 | A | 10/2017 |
| CN | 108138637 | A | 6/2018 |
| DE | 102012112433 | A1 | 6/2014 |
| GB | 2462743 | A | 2/2010 |
| JP | 2007218174 | A | 8/2007 |
| JP | 2010065535 | A | 3/2010 |
| KR | 1020180052710 | A | 5/2018 |

OTHER PUBLICATIONS

EPO, "Supplementary European Search Report for EP Application No. 20945691.2", Munich, Germany, May 31, 2023.

Request for the Submission of an Opinion issued in counterpart Korean Patent Application No. KR 10-2023-7002276, dated May 27, 2024.

First Office Action issued in counterpart Chinese Patent Application No. 202080102250.X, dated Apr. 19, 2025.

* cited by examiner

EXHAUST SILENCING DEVICE AND SYSTEM, VEHICLE, AND EXHAUST SILENCING METHOD

CROSS-REFERENCE TO RELATED PATENT APPLICATION

This application is a U.S. national stage application of PCT Patent Application No. PCT/CN2020/101769, filed Jul. 14, 2020, which is incorporated herein in its entirety by reference.

FIELD OF THE INVENTION

The present application relates to the technical field of exhaust silencing of vehicles, and in particular, to an exhaust silencing device and system, a vehicle, and an exhaust silencing method.

BACKGROUND OF THE INVENTION

In vehicle design, an exhaust silencing system is generally provided in a trunk of a vehicle and configured to reduce exhaust noise of an engine of the vehicle.

With improvement of noise reduction demands for exhaust noise of the vehicle, it is necessary to continuously increase the volume of the exhaust silencing system to reduce noise. However, with the increase of the volume of the exhaust silencing system, a layout space in the rear trunk is occupied too much, which may cause the following three problems:

1) a trunk space is reduced, and it is difficult to arrange a battery, a spare wheel, and other interior components of the vehicle;
2) a gap between the vehicle and the ground is low, and a departure angle is reduced; and
3) it is not beautiful that a silencing cylinder is easily seen from the outside of the vehicle.

At present, conventional fuel vehicles on the market implement noise reduction by increasing the volume of the exhaust silencing system to achieve a noise target.

BRIEF DESCRIPTION OF THE INVENTION

To solve the above technical problems, an exhaust silencing device disclosed in the present application may reduce the volume of a main exhaust silencing cylinder by providing an auxiliary exhaust silencing device, has a good noise reduction effect and a simple structure, and is easy to implement.

To achieve the above invention purposes, the present application provides an exhaust silencing device, including an air intake pipe, a main exhaust silencing cylinder, a main exhaust pipe, a multi-way valve, at least one auxiliary exhaust silencing device, and at least one auxiliary exhaust pipe, where the multi-way valve is in communication with the air intake pipe, the main exhaust pipe, and the auxiliary exhaust pipe respectively;

one end of the main exhaust silencing cylinder is in communication with the multi-way valve by means of the main exhaust pipe, and the other end of the main exhaust silencing cylinder is in communication with the outside; and one end of the auxiliary exhaust silencing device is in communication with the multi-way valve by means of the auxiliary exhaust pipe, and the other end of the auxiliary exhaust silencing device is in communication with the outside.

In an embodiment, the multi-way valve includes a main exhaust port and at least one auxiliary exhaust port which is provided corresponding to the auxiliary exhaust pipe;

the multi-way valve is in communication with the main exhaust pipe by means of the main exhaust port; and the multi-way valve is in communication with the auxiliary exhaust pipe by means of the auxiliary exhaust port.

In an embodiment, the exhaust silencing device further includes at least one one-way solenoid valve, where the one-way solenoid valve is provided corresponding to the auxiliary exhaust port;

the one-way solenoid valve is provided at the auxiliary exhaust port in the multi-way valve; and the one-way solenoid valve is configured to control opening and closing of the auxiliary exhaust port.

In an embodiment, the exhaust silencing device further includes at least one one-way solenoid valve, where the one-way solenoid valve is provided corresponding to the auxiliary exhaust pipe;

the one-way solenoid valve is provided in the auxiliary exhaust pipe; and the one-way solenoid valve is configured to control opening and closing of the auxiliary exhaust pipe.

In an embodiment, the exhaust silencing device further includes a first exhaust pipeline and a second exhaust pipeline, where one end of the first exhaust pipeline is in communication with the main exhaust silencing cylinder, and the other end of the first exhaust pipeline is in communication with the outside; and one end of the second exhaust pipeline is in communication with the auxiliary exhaust silencing device, and the other end of the second exhaust pipeline is in communication with the outside.

In an embodiment, one end of the second exhaust pipeline is in communication with the auxiliary exhaust silencing device, and the other end of the second exhaust pipeline is in communication with the outside by means of the first exhaust pipeline.

In an embodiment, the auxiliary exhaust silencing device includes a housing device having a closed cavity; and one end of the housing device is in communication with the multi-way valve by means of the auxiliary exhaust pipe, and the other end of the housing device is in communication with the outside.

In an embodiment, the auxiliary exhaust silencing device further includes an auxiliary exhaust silencing cylinder fixedly provided in the closed cavity of the housing device; and one end of the auxiliary exhaust silencing cylinder in the housing device is in communication with the multi-way valve by means of the auxiliary exhaust pipe, and the other end of the auxiliary exhaust silencing cylinder is in communication with the outside.

In an embodiment, the auxiliary exhaust silencing cylinder is connected to the housing device by means of a rubber sleeve.

In an embodiment, two auxiliary exhaust silencing devices are provided, and the number of the auxiliary exhaust pipes is the same as that of the auxiliary exhaust silencing devices; and the multi-way valve includes two auxiliary exhaust ports, and the two auxiliary exhaust silencing devices are in communication with the auxiliary exhaust ports of the multi-way valve by means of the auxiliary exhaust pipes.

In an embodiment, the exhaust pipe and the auxiliary exhaust pipe are fixedly connected to the multi-way valve by means of flanges.

Specific advantages: the exhaust silencing device disclosed in the present application may reduce the volume of the main exhaust silencing cylinder by providing the auxiliary exhaust silencing device, has a good noise reduction effect and a simple structure, and is easy to implement.

The present application further describes an exhaust silencing system, including a rotational speed sensor, a throttle sensor, a control device, and the above exhaust silencing device, where the control device is communicatively connected to the rotational speed sensor, the throttle sensor, and the one-way solenoid valve of the exhaust silencing device respectively;

the rotational speed sensor is configured to detect an engine rotation speed of a vehicle;

the throttle sensor is configured to detect a throttle opening of the vehicle;

the control device is configured to receive the engine rotation speed sent by the rotational speed sensor and the throttle opening sent by the throttle sensor;

the control device is configured to analyze and process the engine rotation speed and the throttle opening to obtain an analysis result; and the control device is configured to control the one-way solenoid valve to open or close based on the analysis result.

In an embodiment, the one-way solenoid valve includes a solenoid valve time-sharing control sensor communicatively connected to the control device;

the control device is configured to generate an instruction for controlling the one-way solenoid valve to open or close based on the analysis result, and send the instruction to the solenoid valve time-sharing control sensor; and the solenoid valve time-sharing control sensor is configured to receive the instruction sent by the control device, and execute the instruction.

Specific advantages: the exhaust silencing system disclosed in the present application can control the one-way solenoid valve based on the engine rotation speed and the throttle opening of the vehicle, that is, control opening and closing of the auxiliary exhaust silencing device, can implement time-sharing control, and has a simple control principle.

The present application further describes a vehicle, including a vehicle body and the above exhaust silencing system, where one end of the air intake pipe is in communication with the multi-way valve, and the other end of the air intake pipe is in communication with an exhaust cylinder of the vehicle; and the multi-way valve is provided on a floor of the vehicle body, the main exhaust silencing cylinder is provided at a bottom of a trunk of the vehicle body, and the auxiliary exhaust silencing device is provided at a bottom of the vehicle body.

In an embodiment, a housing device of the auxiliary exhaust silencing device includes a vehicle body rear longitudinal beam, a vehicle body wheel cover plate, or a vehicle body rear enclosing plate.

Specific advantages: the vehicle disclosed in the present application has a relatively small volume of the main exhaust silencing cylinder, and can reduce a rear trunk space occupied by the main exhaust silencing cylinder to improve an utilization rate of the rear trunk space; and a closed cavity structure at the bottom of the vehicle is provided with an auxiliary exhaust silencing cylinder, or an auxiliary exhaust silencing cylinder is provided in a closed cavity structure at the bottom of the vehicle, thereby improving a noise reduction effect of the vehicle on the premise that the volume of the main exhaust silencing cylinder is reduced.

The present application further describes an exhaust silencing method which is implemented based on the above exhaust silencing system, the method including:

obtaining an engine rotation speed and a throttle opening of a vehicle;

determining whether the engine rotation speed and the throttle opening satisfy a preset condition; and if the engine rotation speed and the throttle opening satisfy the preset condition, controlling the main exhaust silencing cylinder and the auxiliary exhaust silencing device of the exhaust silencing device based on a first control strategy.

In an embodiment, determining whether the engine rotation speed and the throttle opening satisfy a preset condition includes:

determining whether the engine rotation speed is not less than a preset first threshold and less than a preset second threshold; determining whether the throttle opening is not less than a preset third threshold and less than a preset fourth threshold; and when the engine rotation speed is not less than the preset first threshold and less than the preset second threshold and/or the throttle opening is not less than the preset third threshold and less than the preset fourth threshold, determining that the engine rotation speed and the throttle opening satisfy the preset condition.

In an embodiment, when the engine rotation speed and the throttle opening do not satisfy the preset condition, the method further includes:

determining whether the engine rotation speed is less than the preset first threshold, and determining whether the throttle opening is less than the preset third threshold; and if the engine rotation speed is less than the preset first threshold and the throttle opening is less than the preset third threshold, controlling the main exhaust silencing cylinder and the auxiliary exhaust silencing device of the exhaust silencing device based on a second control strategy.

In an embodiment, the first control strategy includes controlling the main exhaust silencing cylinder and one auxiliary exhaust silencing device of the exhaust silencing device to open; and the second control strategy includes controlling the main exhaust silencing cylinder to open and controlling the auxiliary exhaust silencing device to close.

In an embodiment, when the engine rotation speed and the throttle opening do not satisfy the preset condition, the method further includes:

determining whether the engine rotation speed is not less than the preset second threshold, and determining whether the throttle opening is not less than the preset fourth threshold; and if the engine rotation speed is not less than the preset second threshold, and the throttle opening is not less than the preset fourth threshold, controlling the main exhaust silencing cylinder and the auxiliary exhaust silencing device of the exhaust silencing device based on a third control strategy.

In an embodiment, the third control strategy includes controlling the main exhaust silencing cylinder and at least one auxiliary exhaust silencing device to open.

In an embodiment, two auxiliary exhaust silencing devices are provided, the method further including:

the third control strategy being controlling the main exhaust silencing cylinder and the two auxiliary exhaust silencing devices to open.

Specific advantages: according to the exhaust silencing method disclosed in the present application, the main exhaust silencing cylinder and the auxiliary exhaust silencing device are controlled by using different control strategies based on changes of the engine rotation speed and the throttle opening, to implement intelligent time-sharing control for the exhaust silencing device.

BRIEF DESCRIPTION OF THE DRAWINGS

In order to more clearly illustrate the technical solutions and advantages of the embodiments of the present application or the prior art, the accompanying drawings required in the descriptions of the embodiments or the prior art will be briefly introduced below. Apparently, the accompanying drawings in the following descriptions are only some embodiments of the present application, and those of ordinary skill in the art may still obtain other drawings from these drawings without creative efforts.

Figure 1:
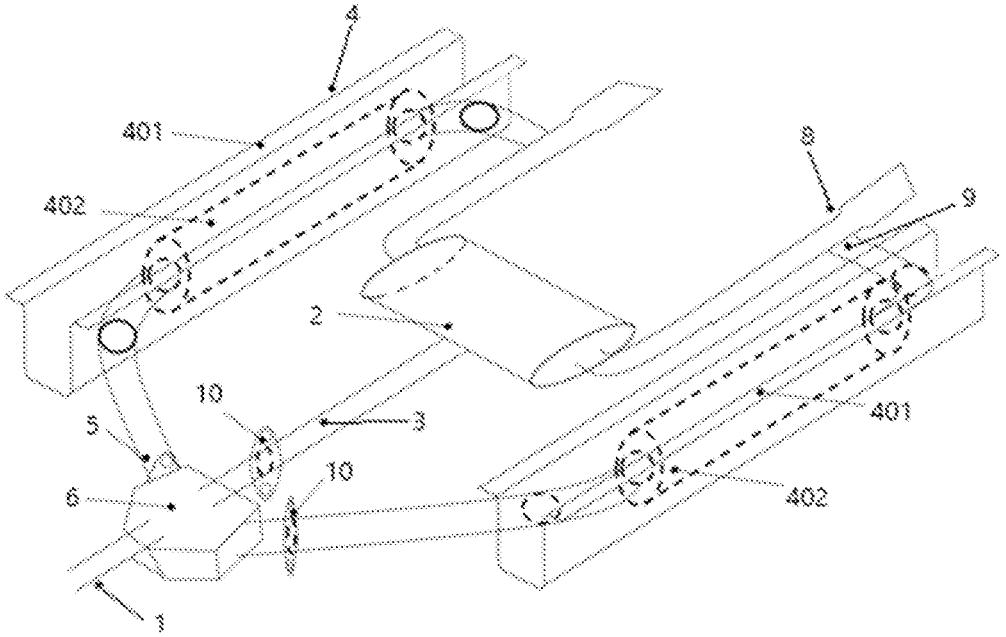
FIG. 1 is a schematic diagram of a stereoscopic structure of an exhaust silencing device.

Reference numerals in the drawings correspondingly are: 1—air intake pipe, 2—main exhaust silencing cylinder, 3—main exhaust pipe, 4—auxiliary exhaust silencing device, 401—housing device, 402—auxiliary exhaust silencing cylinder, 5—auxiliary exhaust pipe, 6—multi-way valve, 7—one-way solenoid valve, 701—solenoid valve time-sharing control sensor, 8—first exhaust pipeline, 9—second exhaust pipeline, and 10—flange.

DETAILED DESCRIPTION

To clarify the purpose, technical solutions and advantages of the present application, the present application will be further described in detail below with reference to the accompanying drawings.

It should be noted that the terms "first", "second", and the like in the specification, the claims, and the drawings of the present application are used to distinguish between similar objects and not necessarily to describe a specific sequence or order. The terms "include" and "have" and any variations thereof are intended to cover a non-exclusive inclusion. In different implementation variations, the same components have the same reference numerals.

FIG. 1 shows a schematic diagram of a stereoscopic structure of an exhaust silencing device disclosed in the present application, and the exhaust silencing device includes an air intake pipe 1, a main exhaust silencing cylinder 2, a main exhaust pipe 3, a multi-way valve 6, at least one auxiliary exhaust silencing device 4, and at least one auxiliary exhaust pipe 5, where the multi-way valve 6 is in communication with the air intake pipe 1, the main exhaust pipe 3, and the auxiliary exhaust pipe 5 respectively;

specifically, an air intake end of the multi-way valve is in communication with the air intake pipe 1, and an exhaust end thereof is in communication with the main exhaust pipe 3 and the auxiliary exhaust pipe 5 respectively;

one end of the main exhaust silencing cylinder 2 is in communication with the multi-way valve 6 by means of the main exhaust pipe 3, and the other end of the main exhaust silencing cylinder is in communication with the outside; and one end of the auxiliary exhaust silencing device 4 is in communication with the multi-way valve 6 by means of the auxiliary exhaust pipe 5, and the other end of the auxiliary exhaust silencing device is in communication with the outside.

Specifically, the multi-way valve 6 includes a main exhaust port and at least one auxiliary exhaust port which is provided corresponding to the auxiliary exhaust pipe 5;

the multi-way valve 6 is in communication with the main exhaust pipe 3 by means of the main exhaust port; and the multi-way valve 6 is in communication with the auxiliary exhaust pipe 5 by means of the auxiliary exhaust port.

As shown in FIG. 1, two auxiliary exhaust silencing devices 4 are provided, and the number of the auxiliary exhaust pipes 5 is the same as that of the auxiliary exhaust silencing devices 4.

Preferably, two auxiliary exhaust ports may be provided, that is, the multi-way valve 6 includes one main exhaust port and two auxiliary exhaust ports, and specifically, two auxiliary exhaust pipes 5 provided correspondingly to the auxiliary exhaust ports are also provided; the two auxiliary exhaust silencing devices 4 are in communication with the auxiliary exhaust ports of the multi-way valve by means of the auxiliary exhaust pipes 5; and at this time, the multi-way valve 6 may be a three-way valve.

Specifically, the exhaust pipe and the auxiliary exhaust pipe 5 are fixedly connected to the multi-way valve 6 by means of flanges 10.

Figure 2:
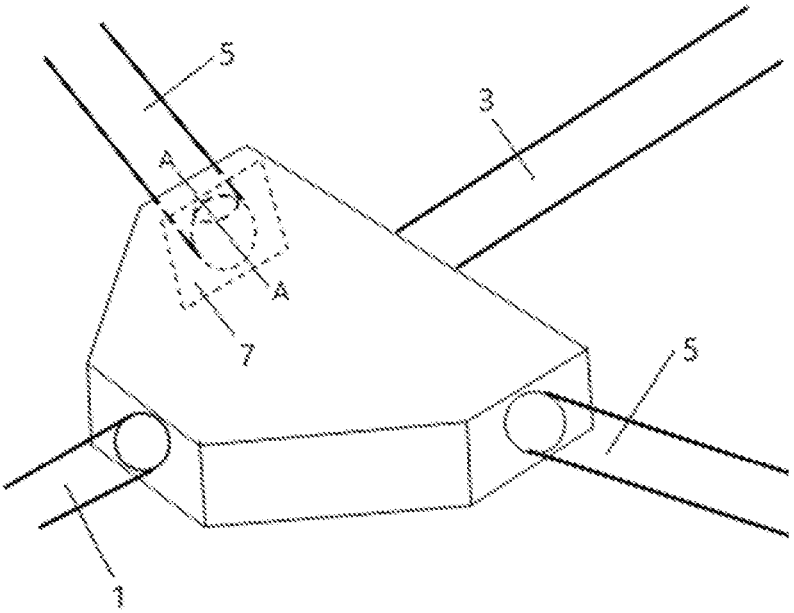
FIG. 2 is a schematic structural diagram of a multi-way valve in an exhaust silencing device.

As shown in FIG. 2, at least one one-way solenoid valve 7 is further included, where the one-way solenoid valve 7 is provided corresponding to the auxiliary exhaust port;

the one-way solenoid valve 7 is provided at the auxiliary exhaust port in the multi-way valve 6; and the one-way solenoid valve 7 is configured to control opening and closing of the auxiliary exhaust port.

As shown in FIG. 2, at least one one-way solenoid valve 7 is further included, where the one-way solenoid valve 7 is provided corresponding to the auxiliary exhaust pipe 5;

the one-way solenoid valve 7 is provided in the auxiliary exhaust pipe 5; and the one-way solenoid valve 7 is configured to control opening and closing of the auxiliary exhaust pipe 5.

Preferably, when two auxiliary exhaust ports and two auxiliary exhaust pipes 5 are provided, two corresponding one-way solenoid valves 7 are also provided, and each one-way solenoid valve 7 controls opening or closing of one auxiliary exhaust port or one auxiliary exhaust pipe 5.

Figure 3:
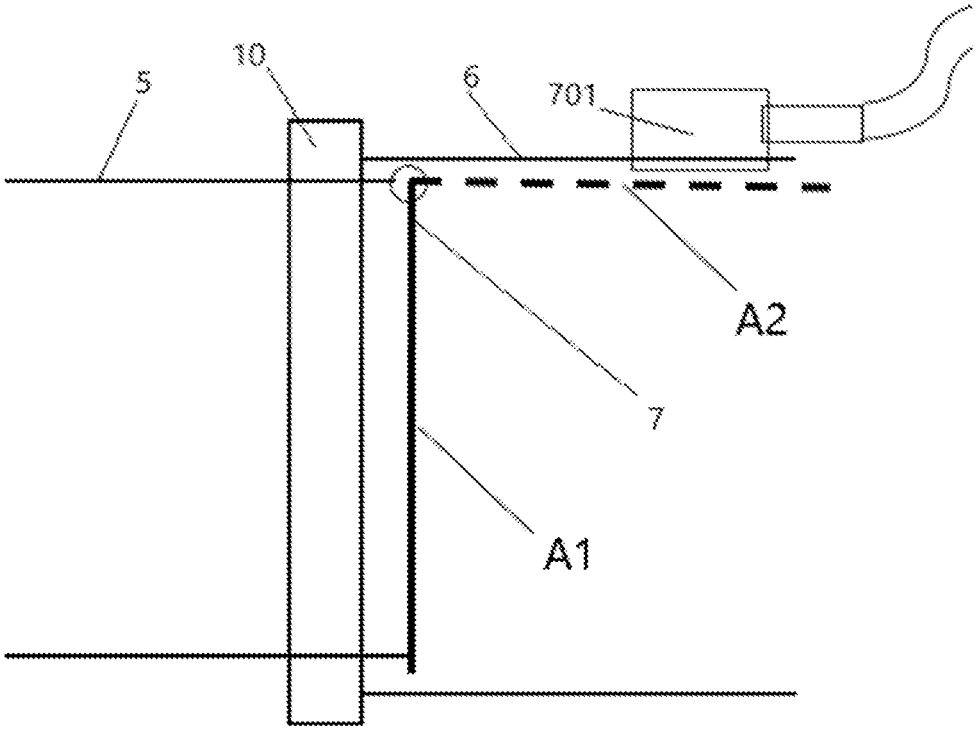
FIG. 3 is an A-A sectional view shown in FIG. 2.

Specifically, as shown in FIG. 3, when the one-way solenoid valve 7 is at A1 position, the one-way solenoid valve 7 is in a closed state, and when the one-way solenoid valve 7 is at A2 position, the one-way solenoid valve 7 is in an open state.

As shown in FIGS. 1 and 2, the exhaust silencing device further includes a first exhaust pipeline 8 and a second exhaust pipeline 9, where one end of the first exhaust pipeline 8 is in communication with the main exhaust silencing cylinder 2, and the other end of the first exhaust pipeline is in communication with the outside; and one end of the second exhaust pipeline 9 is in communication with the auxiliary exhaust silencing device 4, and the other end of the second exhaust pipeline is in communication with the outside. This design may discharge gas in the main exhaust silencing cylinder 2 or the auxiliary exhaust silencing device 4 into the air.

Preferably, one end of the second exhaust pipeline 9 is in communication with the auxiliary exhaust silencing device 4, and the other end of the second exhaust pipeline is in communication with the outside by means of the first exhaust pipeline 8, that is, the second exhaust pipeline 9 discharges exhaust gases into the air by means of the first exhaust pipeline 8.

As shown in FIG. 1, the auxiliary exhaust silencing device 4 includes a housing device 401 having a closed cavity;

one end of the housing device 401 is in communication with the multi-way valve 6 by means of the auxiliary exhaust pipe 5, and the other end of the housing device is in communication with the outside. In the present application, that is, the housing device 401 is directly used as the auxiliary exhaust silencing device 4 to implement a function of exhaust silencing.

Specifically, when the housing device 401 is used as the auxiliary exhaust silencing device 4, the housing device 401 is required to have functions of heat resistance and silencing.

As shown in FIG. 1, the auxiliary exhaust silencing device 4 further includes an auxiliary exhaust silencing cylinder 402 fixedly provided in the closed cavity of the housing device 401.

One end of the auxiliary exhaust silencing cylinder 402 in the housing device 401 is in communication with the multi-way valve 6 by means of the auxiliary exhaust pipe 5, and the other end of the auxiliary exhaust silencing cylinder is in communication with the outside. In the present application, the housing device 401 is provided with the auxiliary exhaust silencing cylinder 402, which enables the housing device 401 and the auxiliary exhaust silencing cylinder 402 to be jointly used as the auxiliary exhaust silencing device 4 to implement the function of exhaust silencing.

Specifically, when the housing device 401 cannot implement the function of exhaust silencing alone, it is necessary to provide the auxiliary exhaust silencing cylinder 402 which can implement the function of exhaust silencing in the housing device 401.

Preferably, a thermal insulating layer and the like may be further provided in the auxiliary exhaust silencing cylinder 402.

Specifically, the auxiliary exhaust silencing cylinder 402 is connected to the housing device 401 by means of a rubber sleeve.

Specifically, one end of the rubber sleeve is fixedly connected to the housing device 401, the other end of the rubber sleeve is fixedly connected to the auxiliary exhaust silencing cylinder 402, and in the present application, by using this soft connection manner, a damping effect during vehicle movement may be strengthened, such that abrasion of the auxiliary exhaust silencing cylinder 402 is reduced, thereby improving a service life of the auxiliary exhaust silencing cylinder 402.

Preferably, the rubber sleeve may be sleeved on the auxiliary exhaust silencing cylinder 402, and an outer wall of the auxiliary exhaust silencing cylinder 402 may further be provided with a buffer layer which has a function of high-temperature resistance.

By providing the auxiliary exhaust silencing device 4, the exhaust silencing device of the present application may reduce the volume of the main exhaust silencing cylinder 2, has a good noise reduction effect and a simple structure, and is easy to implement.

The present application further provides an exhaust silencing system, including a rotational speed sensor, a throttle sensor, a control device, and the above exhaust silencing device;

specifically, the rotational speed sensor, the throttle sensor, and the control device are provided on a vehicle body, and the control device may be an ECU control center;

the control device is communicatively connected to the rotational speed sensor, the throttle sensor, and the one-way solenoid valve 7 of the exhaust silencing device respectively;

the rotational speed sensor is configured to detect an engine rotation speed of a vehicle;

the throttle sensor is configured to detect a throttle opening of the vehicle;

the control device is configured to receive the engine rotation speed sent by the rotational speed sensor and the throttle opening sent by the throttle sensor;

the control device is configured to analyze and process the engine rotation speed and the throttle opening to obtain an analysis result; and the control device is configured to control the one-way solenoid valve 7 to open or close based on the analysis result.

Specifically, the control device is configured to analyze and process the engine rotation speed and the throttle opening, to determine whether the engine rotation speed and the throttle opening satisfy a preset condition; and if the analysis result is that the engine rotation speed and the throttle opening satisfy the preset condition, the control device controls one one-way solenoid valve 7 to open.

If the analysis result is that the engine rotation speed and the throttle opening do not satisfy the preset condition, the control device controls the one-way solenoid valve 7 to close or controls at least one one-way solenoid valve 7 to open.

Specifically, as shown in FIG. 3, the one-way solenoid valve 7 includes a solenoid valve time-sharing control sensor 701 which is communicatively connected to the control device;

the control device is configured to generate an instruction for controlling the one-way solenoid valve 7 to open or close based on the analysis result, and send the instruction to the solenoid valve time-sharing control sensor 701; and the solenoid valve time-sharing control sensor 701 is configured to receive the instruction sent by the control device, and execute the instruction, to make the one-way solenoid valve 7 close or open.

The exhaust silencing system of the present application can control the one-way solenoid valve 7 based on the engine rotation speed and the throttle opening of the vehicle, that is, control opening and closing of the auxiliary exhaust silencing device 4, can implement time-sharing control, and has a simple control principle.

The present application further provides a vehicle, including a vehicle body and the above exhaust silencing system, and one end of the air intake pipe 1 is in communication with the multi-way valve 6, and the other end of the air intake pipe is in communication with an exhaust cylinder of the vehicle; and the multi-way valve 6 is provided on a floor of the vehicle body, the main exhaust silencing cylinder 2 is provided at a bottom of a trunk of the vehicle body, and the auxiliary exhaust silencing device 4 is provided at a bottom of the vehicle body.

Specifically, one end of the air intake pipe 1 away from the multi-way valve 6 is connected to the exhaust cylinder of the vehicle engine.

Specifically, the housing device 401 of the auxiliary exhaust silencing device 4 includes a vehicle body rear longitudinal beam, a vehicle body wheel cover plate, or a vehicle body rear enclosing plate.

Preferably, the housing device 401 is the vehicle body rear longitudinal beam, and the auxiliary exhaust silencing cylinder 402 is fixedly provided in the vehicle body rear longitudinal beam, to implement a function of exhaust silencing.

By providing the auxiliary exhaust silencing device 4, the vehicle disclosed in the present application reduces the volume of the main exhaust silencing cylinder 2, and can reduce a rear trunk space occupied by the main exhaust silencing cylinder 2, thereby improving an utilization rate of the rear trunk space; and a closed cavity structure at the bottom of the vehicle (e.g., a rear longitudinal beam) is directly used as the auxiliary exhaust silencing device 4, or the auxiliary exhaust silencing cylinder 402 is provided in the closed cavity structure at the bottom of the vehicle to use the closed cavity and the auxiliary exhaust silencing cylinder 402 as the auxiliary exhaust silencing device 4 jointly, which is not only easy to implement, but also can improve a noise reduction effect of the vehicle on the premise that the volume of the main exhaust silencing cylinder 2 is reduced.

Figure 4:
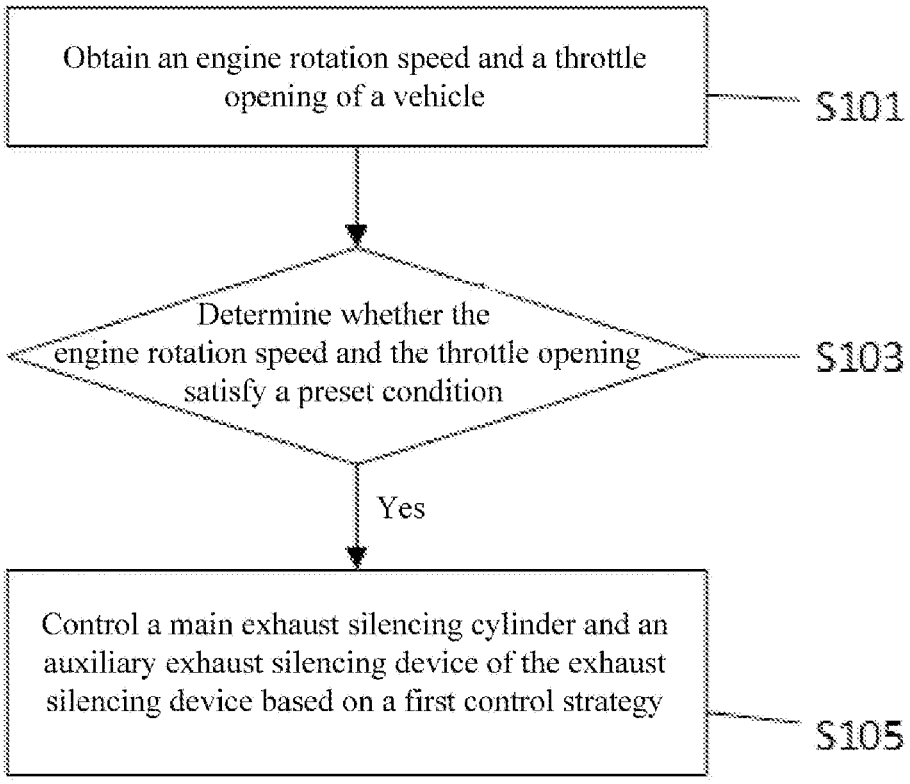
FIG. 4 is a schematic flowchart of an exhaust silencing method.

The present application further provides an exhaust silencing method, which is implemented based on the above exhaust silencing system. As shown in FIG. 4, FIG. 4 is a schematic flowchart of an exhaust silencing method, specifically as follows:

the method includes:

S101: obtaining an engine rotation speed and an throttle opening of a vehicle; and specifically, during a process of vehicle driving, obtaining the engine rotation speed and the throttle opening of the vehicle in real time.

S103: determining whether the engine rotation speed and the throttle opening satisfy a preset condition; and specifically, determining whether the engine rotation speed and the throttle opening satisfy a preset condition includes:

A1, determining whether the engine rotation speed is not less than a preset first threshold and less than a preset second threshold; and determining whether the throttle opening is not less than a preset third threshold and less than a preset fourth threshold; and A2, when the engine rotation speed is not less than the preset first threshold and less than the preset second threshold and/or the throttle opening is not less than the preset third threshold and less than the preset fourth threshold, determining that the engine rotation speed and the throttle opening satisfy the preset condition.

Specifically, when only the engine rotation speed is not less than the preset first threshold and less than the preset second threshold, it may be determined that the engine rotation speed and the throttle opening satisfying the preset condition;

when only the throttle opening is not less than the preset third threshold and less than the preset fourth threshold, it may be determined that the engine rotation speed and the throttle opening satisfying the preset condition; and when the engine rotation speed is not less than the preset first threshold and less than the preset second threshold and the throttle opening is not less than the preset third threshold and less than the preset fourth threshold, it may also be determined that the engine rotation speed and the throttle opening satisfying the preset condition.

Specifically, the preset first threshold may be 3,000 r/min, and the preset second threshold may be 4,000 r/min; and the preset third threshold may be the throttle opening achieving ⅓, and the preset fourth threshold may be the throttle opening achieving ½.

S105: if the engine rotation speed and the throttle opening satisfy the preset condition, controlling a main exhaust silencing cylinder and an auxiliary exhaust silencing device of the exhaust silencing device based on a first control strategy.

Specifically, the first control strategy may be controlling the main exhaust silencing cylinder and one auxiliary exhaust silencing device of the exhaust silencing device to open.

That is, if the engine rotation speed and the throttle opening satisfy the preset condition, the main exhaust silencing cylinder and one auxiliary exhaust silencing device of the exhaust silencing device are controlled to open; and at this time, the main exhaust silencing cylinder and the one auxiliary exhaust silencing device perform exhaust silencing simultaneously, to implement demands for silencing and exhausting of the engine.

After determining whether the engine rotation speed and the throttle opening satisfy a preset condition, the method further includes:

when the engine rotation speed and the throttle opening do not satisfy the preset condition, the method further including:

B1, determining whether the engine rotation speed is less than the preset first threshold, and determining whether the throttle opening is less than the preset third threshold; and B2, if the engine rotation speed is less than the preset first threshold and the throttle opening is less than the preset third threshold, controlling the main exhaust silencing cylinder and the auxiliary exhaust silencing device of the exhaust silencing device based on a second control strategy.

Specifically, the second control strategy may be controlling the main exhaust silencing cylinder to open and controlling the auxiliary exhaust silencing device to close.

That is, if the engine rotation speed is less than the preset first threshold and the throttle opening is less than the preset third threshold, the main exhaust silencing cylinder is controlled to open and the auxiliary exhaust silencing device is controlled to close; and at this time, only the main exhaust silencing cylinder performs the exhaust silencing, and demands for silencing and exhausting of the engine may be implemented.

When the engine rotation speed and the throttle opening do not satisfy the preset condition, the method further includes:

C1, determining whether the engine rotation speed is not less than the preset second threshold, and determining whether the throttle opening is not less than the preset fourth threshold; and C2, if the engine rotation speed is not less than the preset second threshold, and the throttle opening is not less than the preset fourth threshold, controlling the main exhaust silencing cylinder and the auxiliary exhaust silencing device of the exhaust silencing device based on a third control strategy.

Specifically, the third control strategy may be controlling the main exhaust silencing cylinder and at least one auxiliary exhaust silencing device to open.

That is, if the engine rotation speed is not less than the preset second threshold, and the throttle opening is not less than the preset fourth threshold, the main exhaust silencing cylinder and at least one auxiliary exhaust silencing device are controlled to open.

Preferably, when two auxiliary exhaust silencing devices are provided, the third control strategy may be controlling the main exhaust silencing cylinder and the two auxiliary exhaust silencing devices to open; and at this time, an exhaust silencing effect of the engine can be better improved.

The exhaust silencing method of the present application controls the main exhaust silencing cylinder and the auxiliary exhaust silencing device by using different control strategies based on changes of the engine rotation speed and the throttle opening, and implements intelligent time-sharing control for the exhaust silencing device.

The present application further provides an exhaust silencing terminal, the terminal including a processor and a memory, where the memory stores at least one instruction or at least one program, and the at least one instruction or the at least one program is loaded and executed by the processor to implement the parking method described in the above method embodiments.

The memory may be used for storing software programs and modules, and the processor executes various functional applications and data processing by running the software programs and modules stored in the memory. The memory may mainly include a program storage area and a data storage area, where the program storage area may store an operating system, application programs required by a function, etc.; and the data storage area may store data created on the basis of usage of the device, etc. In addition, the memory may include a high-speed random access memory, and may further include a non-volatile memory such as at least one disk memory device, a flash memory device or other volatile solid state memories. Accordingly, the memory may further include a memory controller to provide the processor with access to the memory.

Figure 5:
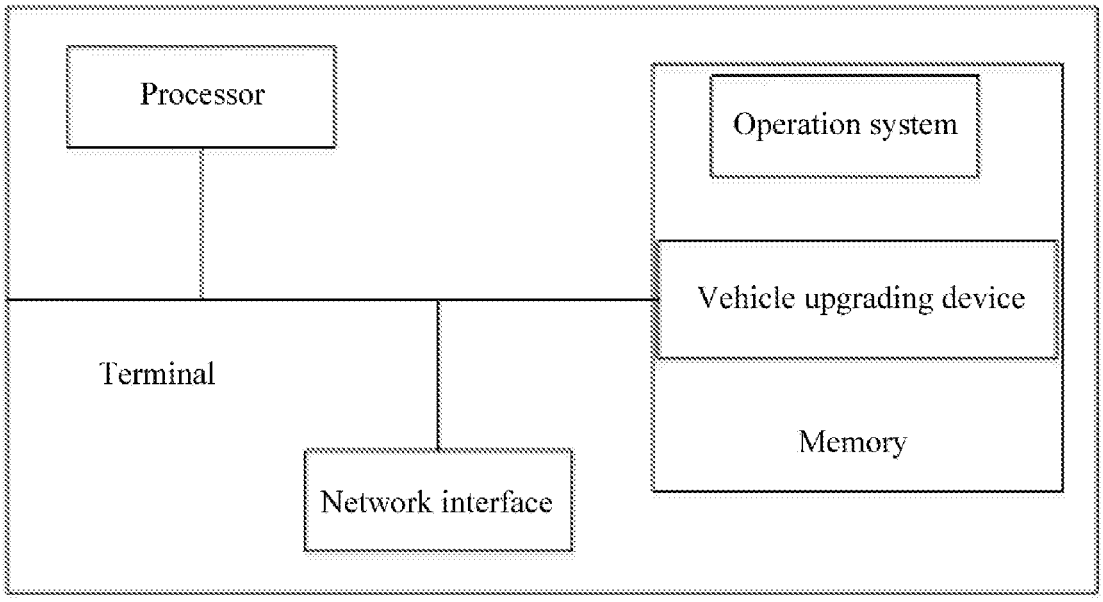
FIG. 5 is a schematic structural diagram of an exhaust silencing terminal.

FIG. 5 is a schematic structural diagram of an exhaust silencing terminal provided by the present application, and interior construction of the exhaust silencing terminal may include, but is not limited to: a processor, a network interface, and a memory, where the processor, the network interface, and the memory in the exhaust silencing terminal may be connected to each other by means of a bus or other manners. In FIG. 5 shown in the embodiments of the specification, bus connection is taken as an example.

The processor (or called as a central processing unit (CPU)) is a computing core and a control core of the exhaust silencing terminal. The network interface may optionally include standard wired interfaces and wireless interfaces (such as WI-FI, and mobile communication interfaces). The memory is a memory device in the exhaust silencing terminal and is configured to store programs and data. It should be understood that the memory herein may be a high speed RAM storage device, may be a non-volatile memory device, such as at least one disk storage device, or may optionally further be at least one storage device away from the foregoing processor. The memory provides a storage space which stores an operation system of the exhaust silencing terminal and the operation system may include but is not limited to: a Windows system (an operation system), a Linux (an operation system), and the like which are not limited by the present invention; and the storage space further stores one or more instructions which are applicable to be loaded and executed by the processor, and these instructions may be one or more computer programs (including program codes). In the embodiments of the specification, the processor loads and executes the one or more instructions stored in the memory, to implement the exhaust silencing method provided by the above method embodiments.

The above disclosure is only a preferred embodiment of the present application, and certainly, the scope of rights of the present application cannot be limited based on this. Therefore, equivalent variations made based on the claims of the present application still fall within the scope encompassed by the present application.

What is claimed is:

1. An exhaust silencing device, comprising an air intake pipe, a main exhaust silencing cylinder, a main exhaust pipe, a multi-way valve, at least one auxiliary exhaust silencing device, and at least one auxiliary exhaust pipe, wherein the multi-way valve is in communication with the air intake pipe, the main exhaust pipe, and the auxiliary exhaust pipe respectively;

one end of the main exhaust silencing cylinder is in communication with the multi-way valve by means of the main exhaust pipe, and the other end of the main exhaust silencing cylinder is in communication with the outside;

one end of the auxiliary exhaust silencing device is in communication with the multi-way valve by means of the auxiliary exhaust pipe, and the other end the auxiliary exhaust silencing device is in communication with the outside;

the auxiliary exhaust silencing device comprises a housing device having a closed cavity; and one end of the housing device is in communication with the multi-way valve by means of the auxiliary exhaust pipe, and the other end of the housing device is in communication with the outside.

2. The exhaust silencing device according to claim 1, wherein the multi-way valve comprises a main exhaust port and at least one auxiliary exhaust port which is provided corresponding to the auxiliary exhaust pipe;

the multi-way valve is in communication with the main exhaust pipe by means of the main exhaust port; and the multi-way valve is in communication with the auxiliary exhaust pipe by means of the auxiliary exhaust port.

3. The exhaust silencing device according to claim 2, further comprising at least one one-way solenoid valve, wherein the one-way solenoid valve is provided corresponding to the auxiliary exhaust port;

the one-way solenoid valve is provided at the auxiliary exhaust port in the multi-way valve; and the one-way solenoid valve is configured to control opening and closing of the auxiliary exhaust port.

4. The exhaust silencing device according to claim 2, further comprising at least one one-way solenoid valve, wherein the one-way solenoid valve is provided corresponding to the auxiliary exhaust pipe;

the one-way solenoid valve is provided in the auxiliary exhaust pipe; and the one-way solenoid valve is configured to control opening and closing of the auxiliary exhaust pipe.

5. The exhaust silencing device according to claim 2, wherein two auxiliary exhaust silencing devices are provided, and the number of the auxiliary exhaust pipes is the same as that of the auxiliary exhaust silencing devices; and the multi-way valve comprises two auxiliary exhaust ports, and the two auxiliary exhaust silencing devices are in communication with the auxiliary exhaust ports of the multi-way valve by means of the auxiliary exhaust pipes.

6. The exhaust silencing device according to claim 1, further comprising a first exhaust pipeline and a second exhaust pipeline, wherein one end of the first exhaust pipeline is in communication with the main exhaust silencing cylinder, and the other end of the first exhaust pipeline is in communication with the outside; and one end of the second exhaust pipeline is in communication with the auxiliary exhaust silencing device, and the other end of the second exhaust pipeline is in communication with the outside.

7. The exhaust silencing device according to claim 6, wherein one end of the second exhaust pipeline is in communication with the auxiliary exhaust silencing device, and the other end of the second exhaust pipeline is in communication with the outside by means of the first exhaust pipeline.

8. The exhaust silencing device according to claim 1, wherein the auxiliary exhaust silencing device further comprises an auxiliary exhaust silencing cylinder fixedly provided in the closed cavity of the housing device; and one end of the auxiliary exhaust silencing cylinder in the housing device is in communication with the multi-way valve by means of the auxiliary exhaust pipe, and the other end of the auxiliary exhaust silencing cylinder is in communication with the outside.

9. The exhaust silencing device according to claim 8, wherein the auxiliary exhaust silencing cylinder is connected to the housing device by means of a rubber sleeve.

10. The exhaust silencing device according to claim 1, wherein the exhaust pipe and the auxiliary exhaust pipe are fixedly connected to the multi-way valve by means of flanges.

11. An exhaust silencing system, comprising a rotational speed sensor, a throttle sensor, a control device, and the exhaust silencing device according to claim 1, wherein the control device is communicatively connected to the rotational speed sensor, the throttle sensor, and a one-way solenoid valve of the exhaust silencing device respectively;

the rotational speed sensor is configured to detect an engine rotation speed of a vehicle;

the throttle sensor is configured to detect a throttle opening of the vehicle;

the control device is configured to receive the engine rotation speed sent by the rotational speed sensor and the throttle opening sent by the throttle sensor;

the control device is configured to analyze and process the engine rotation speed and the throttle opening to obtain an analysis result; and the control device is configured to control the one-way solenoid valve to open or close based on the analysis result.

12. The exhaust silencing system according to claim 11, wherein the one-way solenoid valve comprises a solenoid valve time-sharing control sensor communicatively connected to the control device;

the control device is configured to generate an instruction for controlling the one-way solenoid valve to open or close based on the analysis result, and send the instruction to the solenoid valve time-sharing control sensor; and the solenoid valve time-sharing control sensor is configured to receive the instruction sent by the control device, and execute the instruction.

13. An exhaust silencing method, wherein the exhaust silencing method is implemented based on the exhaust silencing system according to claim 11, and the method comprises:

obtaining an engine rotation speed and a throttle opening of a vehicle;

determining whether the engine rotation speed and the throttle opening satisfy a preset condition; and if the engine rotation speed and the throttle opening satisfy the preset condition, controlling the main exhaust silencing cylinder and the auxiliary exhaust silencing device of the exhaust silencing device based on a first control strategy.

14. The exhaust silencing method according to claim 13, wherein determining whether the engine rotation speed and the throttle opening satisfy a preset condition comprises:

determining whether the engine rotation speed is not less than a preset first threshold and less than a preset second threshold; determining whether the throttle opening is not less than a preset third threshold and less than a preset fourth threshold; and when the engine rotation speed is not less than the preset first threshold and less than the preset second threshold and/or the throttle opening is not less than the preset third threshold and less than the preset fourth threshold, determining that the engine rotation speed and the throttle opening satisfy the preset condition.

15. The exhaust silencing method according to claim 14, wherein when the engine rotation speed and the throttle opening do not satisfy the preset condition, the method further comprises:

determining whether the engine rotation speed is less than the preset first threshold, and determining whether the throttle opening is less than the preset third threshold; and if the engine rotation speed is less than the preset first threshold and the throttle opening is less than the preset third threshold, controlling the main exhaust silencing cylinder and the auxiliary exhaust silencing device of the exhaust silencing device based on a second control strategy.

16. The exhaust silencing method according to claim 15, wherein:

the first control strategy comprises controlling the main exhaust silencing cylinder and one auxiliary exhaust silencing device of the exhaust silencing device to open; and the second control strategy comprises controlling the main exhaust silencing cylinder to open and controlling the auxiliary exhaust silencing device to close.

17. The exhaust silencing method according to claim 14, wherein when the engine rotation speed and the throttle opening do not satisfy the preset condition, the method further comprises:

determining whether the engine rotation speed is not less than the preset second threshold, and determining whether the throttle opening is not less than the preset fourth threshold; and if the engine rotation speed is not less than the preset second threshold, and the throttle opening is not less than the preset fourth threshold, controlling the main exhaust silencing cylinder and the auxiliary exhaust silencing device of the exhaust silencing device based on a third control strategy.

18. The exhaust silencing method according to claim 17, wherein the third control strategy comprises controlling the main exhaust silencing cylinder and at least one auxiliary exhaust silencing device to open.

19. The exhaust silencing method according to claim 18, wherein two auxiliary exhaust silencing devices are provided, and the method further comprises:

the third control strategy being controlling the main exhaust silencing cylinder and the two auxiliary exhaust silencing devices to open.

* * * * *